US008129971B2

(12) United States Patent
Koertzen et al.

(10) Patent No.: US 8,129,971 B2
(45) Date of Patent: Mar. 6, 2012

(54) MULTI-CELL VOLTAGE REGULATOR

(75) Inventors: Henry W. Koertzen, Olympia, WA (US); Joseph T. Dibene, II, Olympia, WA (US)

(73) Assignee: Intel Corporation, Santa Clara, CA (US)

( * ) Notice: Subject to any disclaimer, the term of this patent is extended or adjusted under 35 U.S.C. 154(b) by 262 days.

(21) Appl. No.: 11/957,455

(22) Filed: Dec. 15, 2007

(65) Prior Publication Data

US 2009/0153109 A1 Jun. 18, 2009

(51) Int. Cl.
*G05F 1/40* (2006.01)

(52) U.S. Cl. ..... 323/285

(58) Field of Classification Search ..... 323/268, 323/271, 282, 285; 363/65
See application file for complete search history.

(56) References Cited

U.S. PATENT DOCUMENTS 6,646,425 B2 * 11/2003 Miftakhutdinov ..... 323/285
7,012,408 B2 * 3/2006 Chen ..... 320/152

* cited by examiner

*Primary Examiner* — Matthew Nguyen
(74) *Attorney, Agent, or Firm* — Erik R. Nordstrom

(57) ABSTRACT

In some embodiments, the number of active cells in a multi-cell voltage regulator is controlled so that the current-per-active-cell approaches a predefined target or to be within an acceptable range so that the active cells operate with suitable efficiency.

17 Claims, 5 Drawing Sheets

MULTI-CELL VOLTAGE REGULATOR

TECHNICAL FIELD

The present invention relates generally to power conversion methods and devices and in particular, to integrated, multi-cell regulators.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

The conversion efficiency of a voltage regulator is generally a strong function of its load current. If the load current is much lower than a desired operating range for sufficient efficiency, then its efficiency will typically be unreasonably low. Accordingly, in some embodiments, the number of active cells in a multi-cell voltage regulator is controlled so that the current-per-active-cell approaches a predefined target or to be within an acceptable range so that the active cells operate with suitable efficiency.

Figure 1:
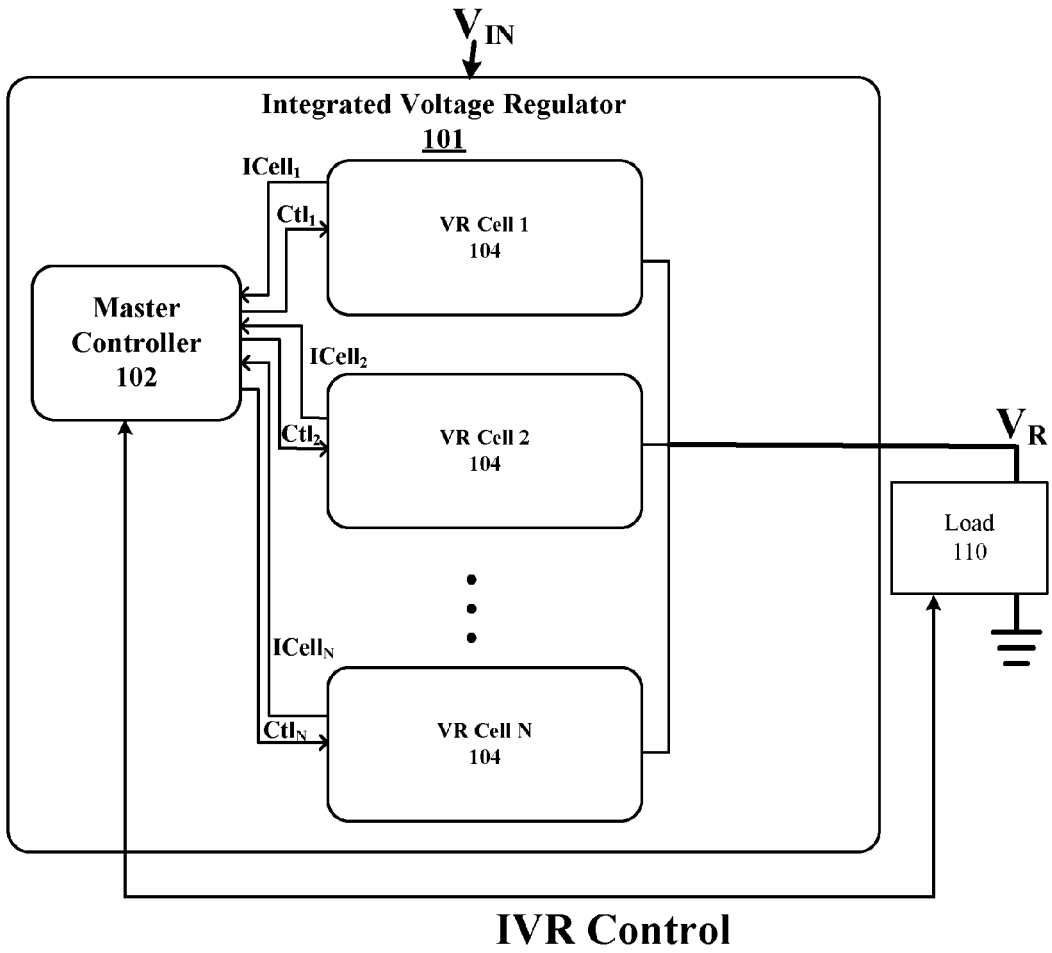
FIG. 1 is a diagram of an integrated, multi-cell voltage regulator in accordance with some embodiments.

FIG. 1 shows an integrated (multi-cell) voltage regulator (IVR) 101 coupled to a load (e.g., processor 110) to provide it with a regulated voltage supply $V_R$ in accordance with some embodiments. IVR 101 generally comprises a master controller 102 and voltage regulator ($V_R$) cells 104 (VR Cell 1 to VR Cell N), coupled together as shown.

The individual VR cell outputs are coupled together to provide the regulated output supply voltage $V_R$. The master controller 102 is coupled to the VR cells 104 to control the cells based on load information from the individual cells (e.g., average per-cell current if generated in the cell or sampled current) and/or from the load (e.g., output voltage, overall output current, and the like). It may also be coupled to the load 110 (e.g., to a power control unit in a processor) to receive from it command and possibly other information to provide a suitable supply ($V_R$) to the load. In some embodiments, it may receive from the load (e.g., processor, system on chip, etc.) activity state information (e.g., Advanced Configuration & Power Interface, ACPI activity states such as C0, C1, C6, etc.) to control the cells based on the load's activity state, as well as on its monitored current demand. As addressed in greater detail below, in some embodiments, the master controller may operate to engage a suitable number of cells (within a range determined from the loads activity state) based on the current presently being consumed. The master controller 102 may comprise any suitable circuitry to perform this function. For example, it could comprise a controller (or other processing unit circuitry); it could comprise discrete logic and analog components configured for the particular purpose of controlling the VR cells 104; or it could comprise a combination of logic elements, analog circuitry, and a more general function controller circuit.

In some embodiments, each VR cell 104 constitutes an independently functioning voltage regulator with it's own controller and power conversion circuitry. For example, a VR 104 may comprise a controller coupled to an array of buck-type switches and output sections, arranged in a multi-phase configuration and coupled, as shown, to provide the regulated output voltage $V_R$. In some embodiments, the output sections could comprise coupled inductors, integrated into the IVR die and/or package. With coupled inductors, the saturation of an inductor is not substantially (if at all) dependent on the load current, resulting in the benefit that a power cell (VR cell 104) can supply a current above its continuous rating for a short duration of time, depending upon the particular thermal conditions and limitations.

In some embodiments, the VR cells 104 may be similarly designed with respect to each other, having comparable (if not equivalent) steady-state output current capabilities. For example, they could each be designed to operate efficiently and reliably in a range of between 1 Amps to 5 Amps, and to provide a regulated DC voltage of around 1 Volt. In addition, they may be designed to operate at a sufficiently high switching frequency so that they can be dynamically engaged and disengaged, in accordance with the operating frequencies of the processor 110, to effectively counter dynamically changing load conditions. For example, sufficient response may be available with each cell having a switching frequency in the range of 20 MHz. to 100 MHz (or even higher), allowing for quick load response, e.g., in the tens of nanoseconds. (Note that in the depicted embodiment, the VR cells including their inductors are integrated into a single chip, e.g., into the die, thereby enabling them to be driven in excess of 20 MHz without excessive switching losses.

Figure 2:
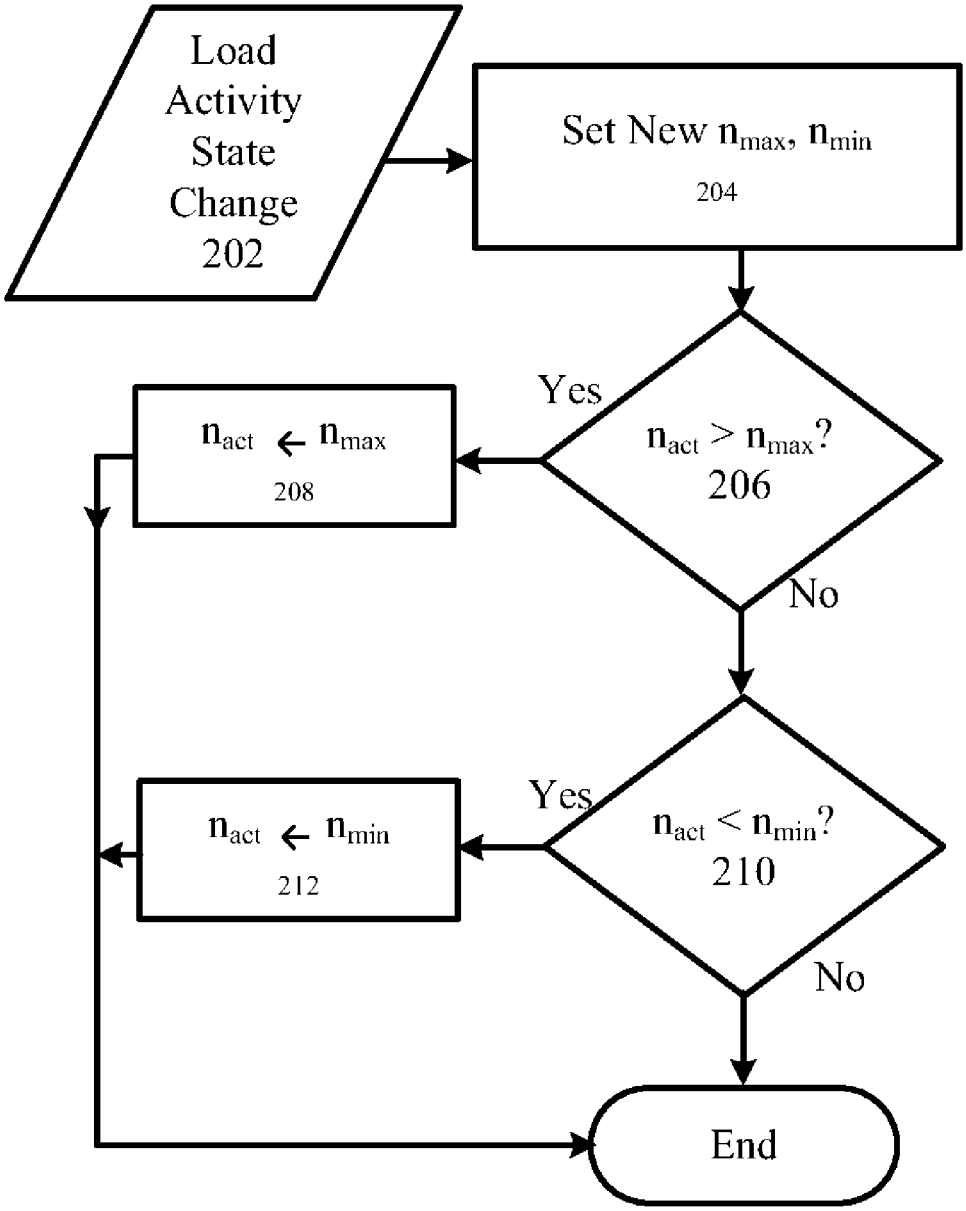
FIG. 2 is a flow diagram for setting boundaries for the number of active cells in accordance with a processor's activity state in accordance with some embodiments.

FIG. 2 shows a routine, which may be executed by the master controller 102, for determining an allowable active cell range, i.e., a range of how many cells in a multi-cell VR may be active based on the activity state of its load, and for controlling the number of active cells so that they stay within the range. For example, this may be desirable to avoid adding or dropping too many cells in response to spurious load current changes. The range limits, themselves, may be predetermined for each possible activity state based on the expected maximum transient and static load conditions for the activity state.

The routine begins at 202 when an activity state change occurs, e.g., it may be communicated to the master controller from the load. For example, with the load being a processor (or processor core), the power control unit (PCU) for the core could communicate to the master controller 102 a C-state change for the processor. At 204, new maximum and minimum limits ($n_{max}$, $n_{min}$) are set. Appropriate range limits could be determined using any suitable methodology. For example, they could be retrieved from a look-up table with the limits defined based on the load activity state.

If the present number of active cells ($n_{act}$) is outside of the range set by the limits ($n_{max}$, $n_{min}$), it gets updated by the routine. At 206, if the number of presently active cells ($n_{act}$) is higher than $n_{max}$, then at 208, $n_{act}$ is changed to $n_{max}$ and proceeds to the end of the routine, until the activity state changes once again. If not, it proceeds to 210 and checks to see if $n_{act}$ is too low, indicating that the cells are operating at an insufficiently low efficiency. If $n_{act}$ is lower than $n_{min}$, then at 212, $n_{act}$ gets changed to $n_{min}$ and the routine proceeds to the end and awaits another state change.

Figure 3:
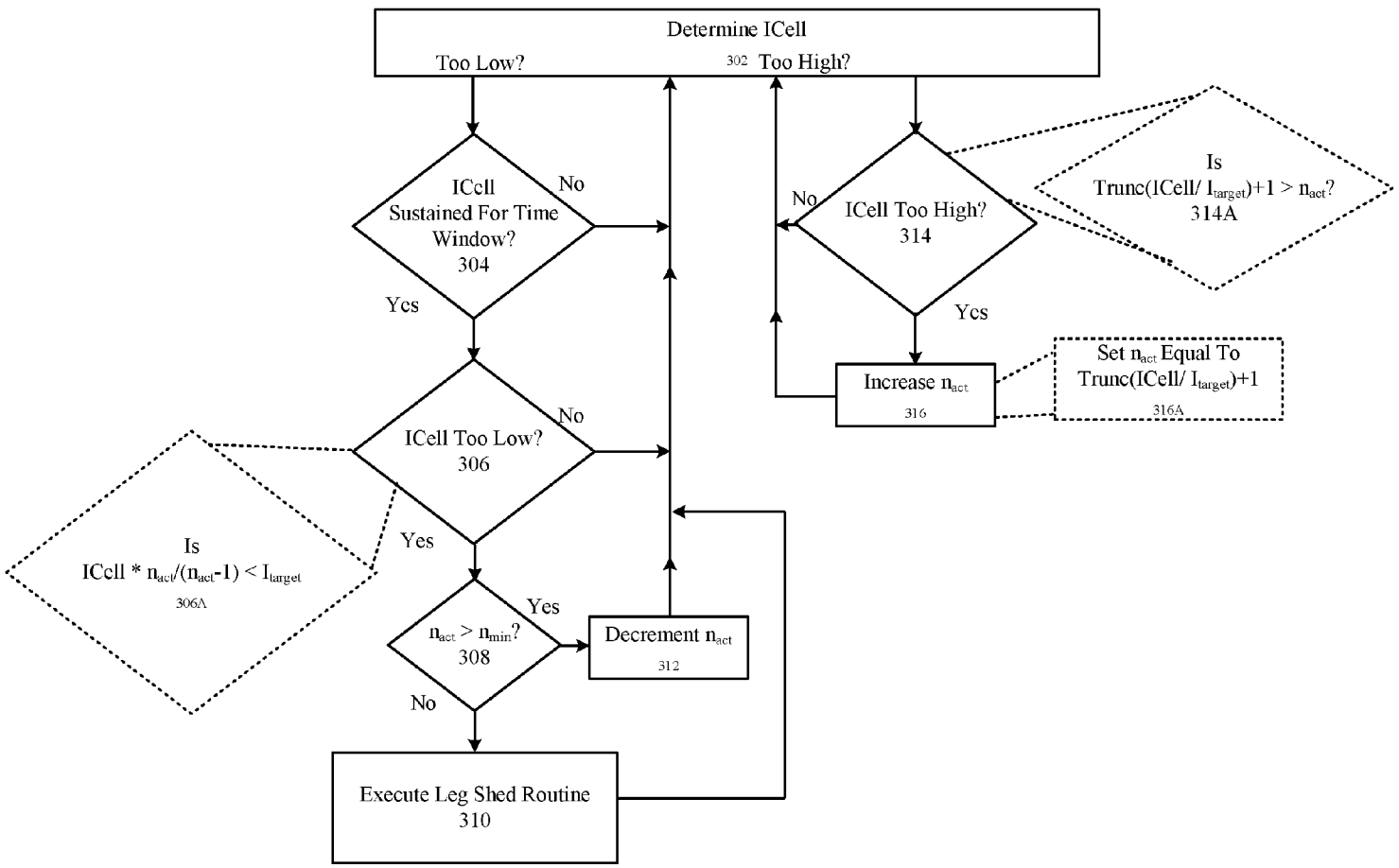
FIG. 3 is a flow diagram of a routine for controlling how many cells are to be active in an integrated, multi-cell regulator such as that shown in FIG. 1, in accordance with some embodiments.

FIG. 3 shows a routine for determining the number ($n_{act}$) of cells that should be active based on the allowable active cell range (e.g., as discussed in the previous section) and on a current-per-active-cell (ICell) value. As used herein, the term "current-per-active-cell" and thus "ICell" refers to a current value, e.g., a current estimation, calculation, measurement, or combination thereof, corresponding to current in an active cell. This value may be attained, directly or indirectly, in a variety of different ways. For example, if the cells are sufficiently balanced with respect to each other, a sample or average value from any of the active cells may suffice. On the other hand, if they are not sufficiently and reliably balanced, then an average or sample from a worst-case cell (e.g., cell with maximum current) may be used. In addition, it doesn't necessarily matter whether the overall output load current or the current for a cell is used. For example, the master controller could acquire a value for the overall output current and either control it directly against a target (or target range), or it could calculate from it an average current per active cell from this value, e.g., if it could be properly assumed that the cell loads are balanced, and then control it against a per-cell current target. In addition, a current or current signal may not actually be calculated or monitored. That is, a voltage (or other) signal, correlating to current, could be used. Accordingly, it should be clear that a particular type of or method for obtaining a current-per-active-cell (ICell) value is not required to practice the teachings of this invention, and thus, the invention is not so limited.

Essentially, the routine of FIG. 3 operates to control ICell to approach a target current ($I_{target}$), which in this embodiment, is the same for every operating activity state. (Remember that the power conversion efficiency for each cell is not affected by the amount of overall load current but rather, by the current provided by the cell.) If the current-per-active-cell (ICell) is too low, it attempts to decrease the number of active cells ($n_{act}$) to increase the current-per-active-cell, and if it is too high, it attempts to increase the number of active cells to decrease the current-per-active-cell.

Initially, at 302, it determines a current-per-active-cell (ICell) value (e.g., highest cell current of the active cells). From here, there are two paths (Too Low, Too High) that may execute simultaneously. With the first (Too Low) path, the routine determines at 304 if the ICell value is sustained for a sufficient amount of time, i.e., over a sufficient window. It does this for stability purposes to avoid dropping cells in response to short-lived droops. If ICell is at (or below) a given value for a sufficient amount of time, then at 306, it determines if this ICell value is too low. For example, as indicated at 306A, in determining if ICell is too low, the routine could adjust ICell by an amount that is inversely proportional to the number of active cells to bias it in favor of making it more difficult to drop a cell as $n_{act}$ decreases. At 306A, ICell is multiply by $n_{act}/n_{act}-1$) to so bias it.

Figure 4:
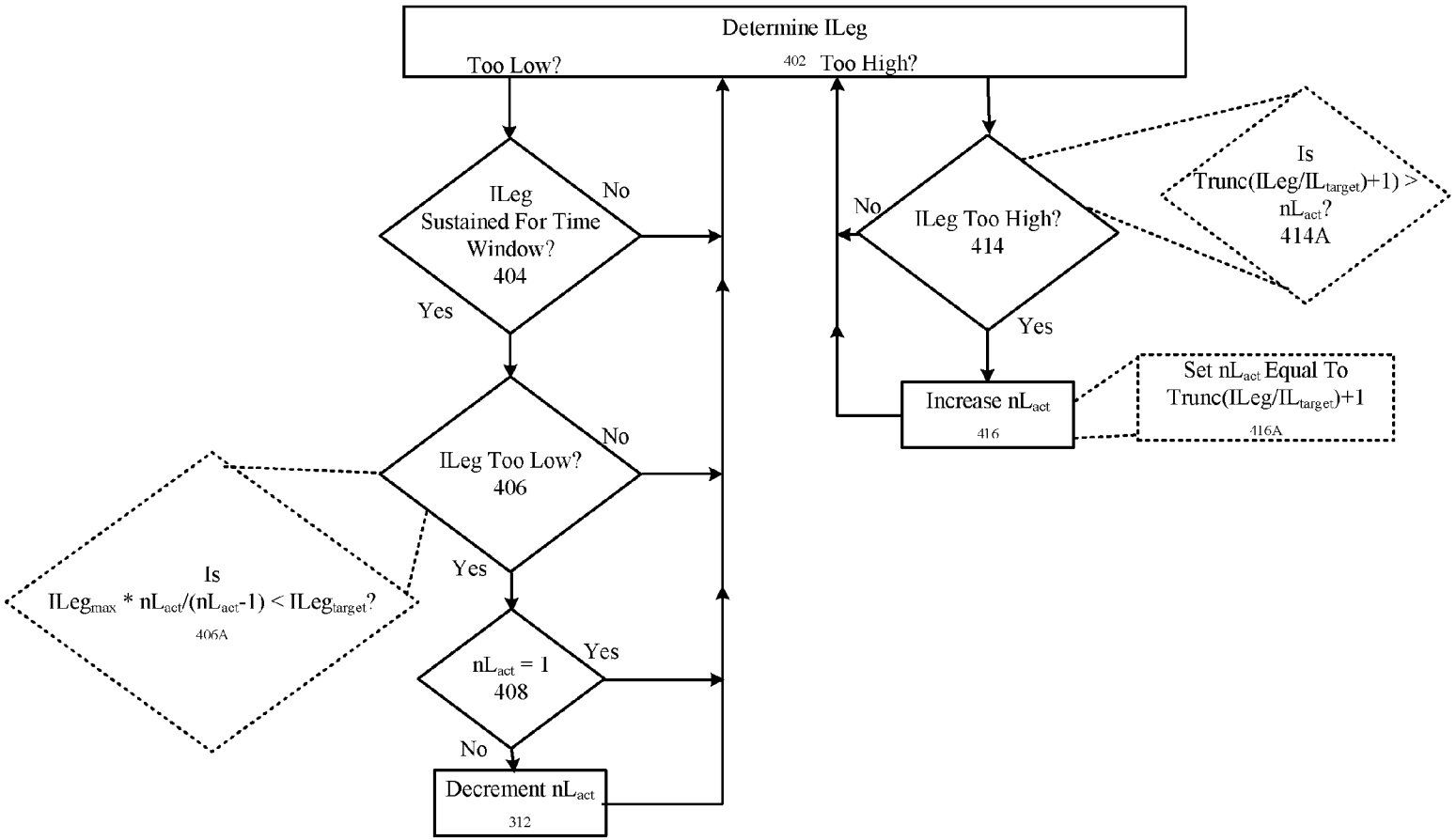
FIG. 4 is a flow diagram of a routine for controlling how many legs in a regulator cell are to be active in accordance with some embodiments.

If ICell is not too low, then the routine returns to 302, but if ICell is in fact too low, then at 308, it checks to see if the number of presently active cells ($n_{act}$) is greater than $n_{min}$. If $n_{act}$ is greater than $n_{min}$, then the routine proceeds to 312 and decrements $n_{act}$, i.e., drops a cell and returns back to 302. However, at 308, if $n_{act}$ was determined not to be greater than $n_{min}$, then the routine goes to 310 (maintaining $n_{act}$ at its present level) and causes a switch-leg shedding routine to be executed. With switch-leg shedding, power can additionally be saved by dropping one or more switch legs in active cell(s). An example of such a routine is shown in FIG. 4. From here, the routine returns back to 302.

(Switch leg shedding involves disabling one or more switch legs that are coupled in parallel with each other to control the power that is provided to a phase leg, e.g., to the inductor in the phase. This is contrasted from phase shedding where phase legs are dropped. With switch leg shedding, the phases remain active, but the size of the bridge, or switch, transistors are effectively adjusted to decrease or increase bridge impedance to improve the bridge efficiency as a function of load current. This is done by enabling or disabling selected combinations of the parallel switch legs that make up the bridge. An advantage of switch leg shedding versus phase shedding is that it is transparent to circuit operation and can more effectively be used with coupled inductors)

The "Too High" path from 302 will now be described. At 314, the routine determines if the ICell value is too high. (Note that it does not first confirm, unlike with the other path, that an ICell value is sustained for a sufficient amount of time because, in this embodiment, it is to respond as quickly as is reasonably possible to compensate for, e.g., instantaneous and sustained load line increases. With this in mind, the logic, e.g., dedicated logic circuits, for executing the actions in this path may be particularly designed for fast processing.)

An example of a way to determine if ICell is too high is shown at 314A. Here, the routine determines if a truncated value of (ICell/Itarget)+1 is greater than $n_{act}$. (Note that it is biased in favor of determining that ICell is too high, which will result in a cell or cells being added.) If ICell is too high, then at 316, the number of active cells is increased. For example, at 316A, the value of $n_{act}$ is set to the truncation of $(ICell/I_{target})+1$. In this way, $n_{act}$ can be increased by more than 1 to quickly compensate for current spikes. In other embodiments, $n_{act}$ could simply be incremented or increased using another method. After $n_{act}$ is increased, the routine returns back to 302.

Disabling cells is an effective way of improving efficiency. However, as encountered at 310 above, once the minimum number of active cells has been reached, then adjusting the size of the active cell's transistor bridge (i.e., decreasing the number of active switch legs in their bridges) is another way to improve efficiency. This may be implemented in the controllers of the remaining active cell(s). A routine for changing the number of active switch legs in a cell may be similar to that for changing the number of cells, as is reflected in the routine of FIG. 4.

FIG. 4 shows a routine for determining how many switch legs should be active in an active cell. This routine is similar to the routine of FIG. 3 and thus it will not be discussed in as much detail. ILeg is akin to ICell and is the per-switch-leg current in the cell, and $nL_{act}$ is the number of presently active switch legs. (As with ICell, ILeg may be determined in a variety of different ways and could correspond to the overall cell current rather than having to be a leg current. That is, instead of ILeg being an actual per-leg current, it could correspond to the overall cell output current with $I_{target}$ being appropriately adjusted.)

Figure 5:
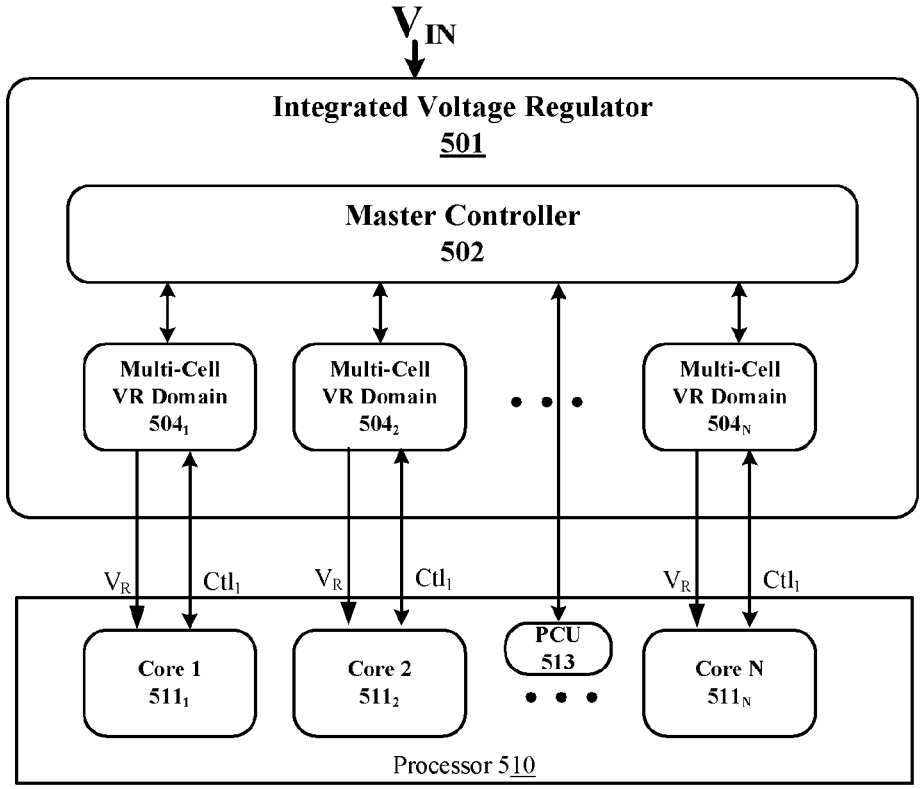
FIG. 5 is a diagram of an integrated, multi-cell voltage regulator divided into multiple domains to supply regulated voltage supplies for multiple cores in a multi-core processor in accordance with some embodiments.

FIG. 5 shows an embodiment of a multi-cell IVR 501 coupled to provide regulated voltage supplies for associated cores in a multi-core processor 510. The multi-cell IVR 501 has multiple multi-cell VR domains 504 (504$_1$ to 504$_N$) each comprising multiple cells as discussed above and each being coupled to an associated core 511 ($511_1$ to $511_N$) in the processor 510. Each IVR 504 comprises multiple cells that are controlled for efficient operation, e.g., pursuant to the routines of FIGS. 2 to 4, to provide a regulated voltage supply to its associated processor core. As with the IVR of FIG. 1, IVR 501 has a master controller 502 to control each of the IVR domains 504 to enable and disable cells within the domain based on information from the core loads, as well as from a power control unit (PCU) 513 in the processor.

Figure 6:
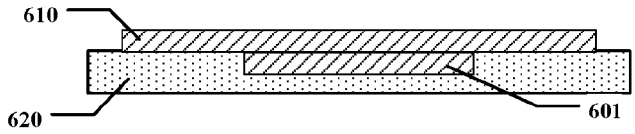
FIG. 6 is a side view of an integrated circuit package with a multi-cell regulator and a multi-core processor in accordance with some embodiments.

FIG. 6 shows a cross-sectional view of a multi-core microprocessor (such as the processor of FIG. 5) integrated circuit (IC). It comprises a multi-cell integrated voltage regulator (IVR) die 601 and a multi-core microprocessor die 610 coupled together as shown. The IVR die 601 is embedded within a package substrate 620, while the microprocessor die is mounted to the substrate 620 and against the IVR die 601 for efficient signal conductivity. (In this embodiment, the substrate 620 serves as a package substrate for both the processor 610 and IVR 601. Note that the dies may or may not actually contact one another. they may have one or more other materials sandwiched between them throughout some or all of their abutting surface portions. Such materials could be used for structural stability, heat transfer purposes, power and signal grids, or the like.)

The IVR die 601 may comprise one or more multi-cell VR domains, while the microprocessor die 610 may comprise one or more domain cores, as described above. With this package configuration, with the dies mounted next to one another, circuit elements for VR domains can be disposed more proximal to their associated domain core elements. This can allow for sufficient conductive paths (e.g., via solder bumps or other contacts) to conduct relatively large amounts of current to the domain cores. (It should be appreciated that any suitable package configuration using one or more dies to implement the domain cores and VRs may be implemented and are within the scope of the present invention. For example, the IVR die could be "atop" the microprocessor die instead of "below" it. Alternatively it could be next to it, partially against it, or they could be part of the same die.)

Figure 7:
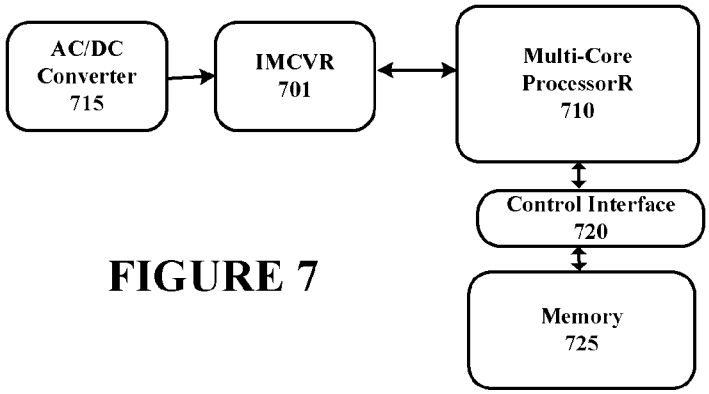
FIG. 7 is a diagram of a portion of a computer system with a multi-core processor and multi-cell regulator in accordance with some embodiments.

With reference to FIG. 7, one example of a portion of a computer platform (e.g., computing system such as a desktop or server computer, PDA, cell phone, or the like) is shown. The represented portion comprises one or more processors 710, multi-cell voltage regulator (MCVR) 701, AC/DC converter 715, interface control functionality 720, and memory 725, coupled as shown. (Note that in most systems, there will be other components such as input/output devices and other peripheral components to facilitate additional memory, backup, network connectivity, and the like.) The AC/DC converter 715 is coupled to the MCVR 701 to provide it with a DC supply so that it can provide the processor 710 with one or more regulated supplies, as discussed. (In some embodiments, there may be one or more intervening converters between the converter 715 and MCVR 701.) The processor(s) 710 is coupled to the memory 710 through the control functionality 720. The control functionality may comprise one or more circuit blocks to perform various interface control functions (e.g., memory control, graphics control, I/O interface control, and the like. These circuits may be implemented on one or more separate chips and/or may be partially or wholly implemented within the processor(s) 710.

The memory 725 comprises one or more memory blocks to provide additional random access memory to the processor(s) 710. it may be implemented with any suitable memory including but not limited to dynamic random access memory, static random access memory, flash memory, combinations of the same, or the like.

In the preceding description, numerous specific details have been set forth. However, it is understood that embodiments of the invention may be practiced without these specific details. In other instances, well-known circuits, structures and techniques may have not been shown in detail in order not to obscure an understanding of the description. With this in mind, references to "one embodiment", "an embodiment", "example embodiment", "various embodiments", etc., indicate that the embodiment(s) of the invention so described may include particular features, structures, or characteristics, but not every embodiment necessarily includes the particular features, structures, or characteristics. Further, some embodiments may have some, all, or none of the features described for other embodiments.

In the preceding description and following claims, the following terms should be construed as follows: The terms "coupled" and "connected," along with their derivatives, may be used. It should be understood that these terms are not intended as synonyms for each other. Rather, in particular embodiments, "connected" is used to indicate that two or more elements are in direct physical or electrical contact with each other. "Coupled" is used to indicate that two or more elements co-operate or interact with each other, but they may or may not be in direct physical or electrical contact.

The invention is not limited to the embodiments described, but can be practiced with modification and alteration within the spirit and scope of the appended claims. For example, it should be appreciated that the present invention may be applicable for use with all types of semiconductor integrated circuit ("IC") chips. Examples of these IC chips include but are not limited to processors, controllers, chip set components, programmable logic arrays (PLA), memory chips, network chips, and the like.

It should also be appreciated that in some of the drawings, signal conductor lines are represented with lines. Some may be thicker, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

It should be appreciated that example sizes/models/values/ranges may have been given, although the present invention is not limited to the same. As manufacturing techniques (e.g., photolithography) mature over time, it is expected that devices of smaller size could be manufactured. In addition, well known power/ground connections to IC chips and other components may or may not be shown within the FIGS, for simplicity of illustration and discussion, and so as not to obscure the invention. Further, arrangements may be shown in block diagram form in order to avoid obscuring the invention, and also in view of the fact that specifics with respect to implementation of such block diagram arrangements are highly dependent upon the platform within which the present invention is to be implemented, i.e., such specifics should be well within purview of one skilled in the art. Where specific details (e.g., circuits) are set forth in order to describe example embodiments of the invention, it should be apparent to one skilled in the art that the invention can be practiced without, or with variation of, these specific details. The description is thus to be regarded as illustrative instead of limiting.

What is claimed is:

1. An apparatus, comprising:

an integrated circuit package comprising a plurality of voltage regulator cells coupled together to provide a regulated output voltage supply to a load; and a controller coupled to the cells to control the number of cells that are engaged to contribute current to the load based on monitored load current and on an activity state for the load, wherein the controller controls the number of engaged cells so that the current-per-active-cell stays within a target current range.

2. The apparatus of claim 1, in which the load is a multi-core processor, and the activity state is a core activity state.

3. The apparatus of claim 1, in which the controller controls the number of engaged cells so that the current-per-active-cell approaches a target current value.

4. The apparatus of claim 3, in which the target current value stays the same regardless of the activity state.

5. The apparatus of claim 1, in which the number of engaged cells are controlled to be within an active cell range, said range being defined based on the activity state.

6. The apparatus of claim 1, in which the controller is biased to be less likely to drop a cell as the number of actively engaged cells goes down.

7. The apparatus of claim 1, in which the controller is biased to be more likely to add an engaged cell when the current demand goes up when the number of engaged cells is lower than otherwise.

8. The apparatus of claim 1, in which the monitored current at least partially monitored current from one or more of the engaged cells.

9. The apparatus of claim 1, in which the monitored current comprises current provided to the load.

10. An apparatus, comprising:

an integrated circuit package comprising:

a processor with one or more cores; and a voltage regulator having one or more domains to independently provide the one or more cores with regulated voltage supplies, wherein each domain includes a plurality of VR cells to be controlled so that the number of active cells to provide current to an associated core is based on monitored current demand for the core and on an activity state for the core, and wherein the number of active cells in a domain is controlled to be within an acceptable range that is defined based on the activity state for its associated core.

11. The apparatus of claim 10, in which the processor comprises a power control unit to provide the activity state for each of the one or more cores.

12. The apparatus of claim 10, in which the monitored current for a core includes current for one or more of the active cells providing it with current.

13. The apparatus of claim 10, in which the monitored current for a core includes overall current provided to the core.

14. The apparatus of claim 10, in which the number of active cells is controlled so that the current-per-active cell approaches a target current value.

15. A system, comprising:

a processor;

a voltage regulator having a plurality of voltage regulator cells coupled together to provide a regulated output voltage supply to the processor, and a controller coupled to the cells to control the number of cells that are engaged to contribute current to the processor based on monitored processor load current and on an activity state for the processor, wherein the controller controls the number of engaged cells so that the current-per-active-cell stays within a target current range; and an AC/DC adaptor to provide the voltage regulator with a DC supply, the voltage regulator and processor being part of a single integrated circuit package.

16. The system of claim 15, in which the controller controls the number of engaged cells so that the current-per-active-cell approaches a target current value.

17. The system of claim 16, in which the target current value stays the same regardless of the activity state.

* * * * *